US010128619B2

(12) United States Patent
Morgan et al.

(10) Patent No.: US 10,128,619 B2
(45) Date of Patent: Nov. 13, 2018

(54) GROUND SHIELD FOR A CONTACT MODULE

(71) Applicants: TE CONNECTIVITY CORPORATION, Berwyn, PA (US); TYCO ELECTRONICS JAPAN G.K., Kawasaki-Shi (JP)

(72) Inventors: Chad William Morgan, Carneys Point, NJ (US); John Joseph Consoli, Harrisburg, PA (US); Masaaki Iwasaki, Yokohama (JP); Justin Dennis Pickel, Hummelstown, PA (US); Masayuki Aizawa, Machida (JP)

(73) Assignees: TE CONNECTIVITY CORPORATION, Berwyn, PA (US); TYCO ELECTRONICS JAPAN G.K., Kawasaki-Shi (JP)

( * ) Notice: Subject to any disclaimer, the term of this patent is extended or adjusted under 35 U.S.C. 154(b) by 0 days.

(21) Appl. No.: 15/417,413

(22) Filed: Jan. 27, 2017

(65) Prior Publication Data

US 2018/0219329 A1 Aug. 2, 2018

(51) Int. Cl.
*H01R 13/6585* (2011.01)
*H01R 12/72* (2011.01)

(52) U.S. Cl.
CPC ..... *H01R 13/6585* (2013.01); *H01R 12/724* (2013.01)

(58) Field of Classification Search
CPC ..... H01R 13/6585; H01R 13/6586; H01R 13/6587; H01R 13/688; H01R 13/658
USPC ..... 439/607.05–607.09
See application file for complete search history.

(56) References Cited

U.S. PATENT DOCUMENTS 6,843,687 B2 1/2005 McGowan et al.
7,618,289 B2 * 11/2009 Rothermel ..... H01R 29/00 439/49
7,963,806 B1 * 6/2011 Scott Kline ..... H01R 13/642 439/607.08
8,183,466 B2 5/2012 Morlion et al.
8,398,434 B2 3/2013 Davis et al.
8,444,434 B2 5/2013 Davis et al.
8,579,636 B2 11/2013 Davis et al.
8,591,257 B2 * 11/2013 Girard ..... H01R 13/6473 439/607.07
8,591,260 B2 11/2013 Davis et al.
8,628,356 B2 * 1/2014 Laurx ..... H01R 12/737 439/628
8,690,604 B2 4/2014 Davis
8,771,017 B2 7/2014 Vino, IV et al.
8,777,663 B2 7/2014 Annis et al.
(Continued)

*Primary Examiner* — Tulsidas C Patel
*Assistant Examiner* — Marcus Harcum

(57) ABSTRACT

A contact module includes a dielectric holder holding signal contacts and guard traces. The guard traces are electrically commoned and provide electrical shielding between the corresponding signal contacts. A ground shield is coupled to a first side of the dielectric holder and provides electrical shielding for the signal contacts. The ground shield is electrically connected to each guard trace and has a plurality of rails. Each rail has side strips aligned with the signal contacts and connecting strips extending inward from a first edge of the side strip into the dielectric holder to directly engage the corresponding guard traces. The rails are generally L-shaped defined by the side strips and corresponding connecting strips.

20 Claims, 8 Drawing Sheets

(56) References Cited

U.S. PATENT DOCUMENTS

| | | | | |
|---|---|---|---|---|
| 8,870,594 | B2 * | 10/2014 | McClellan | H01R 9/22 439/607.05 |
| 8,992,252 | B2 * | 3/2015 | McClellan | H01R 13/6581 439/108 |
| 9,331,407 | B2 * | 5/2016 | Laurx | H01R 13/6587 |
| 2014/0106583 | A1 * | 4/2014 | Vino, IV | H01R 13/6587 439/95 |
| 2014/0148054 | A1 * | 5/2014 | Annis | H01R 13/518 439/607.05 |
| 2016/0181732 | A1 | 6/2016 | Laurx et al. | |

* cited by examiner

GROUND SHIELD FOR A CONTACT MODULE

BACKGROUND OF THE INVENTION

The subject matter herein relates generally to shielding structures for contact modules of electrical connectors.

Some electrical systems utilize electrical connectors, such as header assemblies and receptacle assemblies, to interconnect two circuit boards, such as a motherboard and daughtercard. Some known electrical connectors include a front housing holding a plurality of contact modules arranged in a contact module stack. The electrical connectors provide electrical shielding for the signal conductors of the contact modules. For example, ground shields may be provided on one or both sides of each contact module. However, at high speeds, the electrical shielding of known electrical connectors may be insufficient. For example, while the ground shield(s) may provide shielding along the sides of the signal conductors, known electrical connectors do not provide sufficient additional electrical shielding above and/or below the signal conductors throughout the length of the contact modules. For example, the additional electrical shielding may only be provided at the mating interface with the mating electrical connector and not along the length of the signal conductors between the mating end and the mounting end mounted to the circuit board.

For contact modules that provide guard traces or ground contacts interspersed with the signal contacts to provide shielding therebetween, there is insufficient electrical commoning of the ground contacts with the ground shields along the sides of the contact modules. For example, some known contact modules only electrically common the ground shields and the ground contacts at the circuit board and at the mating electrical connector. However, the transition sections of the ground contacts are not electrically commoned with the ground shields.

A need remains for a shielding structure for contact modules allowing electrical commoning of guard traces and ground shields along the lengths of the guard traces to provide robust electrical shielding for the signal contacts.

BRIEF DESCRIPTION OF THE INVENTION

In one embodiment, a contact module is provided including a dielectric holder having first and second sides extending between a mating end and a mounting end. Signal contacts are held by the dielectric holder along a contact plane defined between the first and second sides. The signal contacts have mating portions extending from the mating edge, mounting portions extending from the mounting edge for termination to a circuit board, and transition portions extending through the dielectric holder between the mating and mounting portions. Guard traces are held by the dielectric holder along the contact plane between corresponding signal contacts. The guard traces are electrically commoned and provide electrical shielding between the corresponding signal contacts. A ground shield is coupled to the first side of the dielectric holder and provides electrical shielding for the signal contacts. The ground shield is electrically connected to each of the guard traces. The ground shield has a plurality of rails for electrically shielding corresponding signal contacts. Each rail has side strips having first and second edges and being configured to be aligned with the transition portions of corresponding signal contacts along the first side. Each rail has connecting strips extending inward from the first edges of the side strips into the dielectric holder to directly engage the corresponding guard traces. The rails are generally L-shaped defined by the side strips and corresponding connecting strips.

In another embodiment, a shield structure is provided for a contact module having a dielectric holder holding signal contacts and guard traces between corresponding signal contacts. The shield structure includes a ground shield configured to extend along a right side of the dielectric holder having a main body with a plurality of rails separated by gaps. The rails have side strips configured to extend along a first side of the dielectric holder and having first and second edges. The rails have connecting strips extending inward from the first edges of the side strips configured to extend into the dielectric holder to directly engage the corresponding guard traces. The rails are generally L-shaped defined by the side strips and corresponding connecting strips.

In a further embodiment, an electrical connector is provided including a housing having a mating end and contact modules arranged in a contact module stack received in and extending from the housing for termination to a circuit board. Each contact module includes a dielectric holder having first and second sides extending between a mating end and a mounting end. Signal contacts are held by the dielectric holder along a contact plane defined between the first and second sides. The signal contacts have mating portions extending from the mating edge, mounting portions extending from the mounting edge for termination to a circuit board, and transition portions extending through the dielectric holder between the mating and mounting portions. Guard traces are held by the dielectric holder along the contact plane between corresponding signal contacts. The guard traces are electrically commoned and provide electrical shielding between the corresponding signal contacts. A ground shield is coupled to the first side of the dielectric holder and provides electrical shielding for the signal contacts. The ground shield is electrically connected to each of the guard traces. The ground shield has a plurality of rails for electrically shielding corresponding signal contacts. Each rail has side strips having first and second edges and being configured to be aligned with the transition portions of corresponding signal contacts along the first side. Each rail has connecting strips extending inward from the first edges of the side strips into the dielectric holder to directly engage the corresponding guard traces. The rails are generally L-shaped defined by the side strips and corresponding connecting strips.

DETAILED DESCRIPTION OF THE INVENTION

Figure 1:
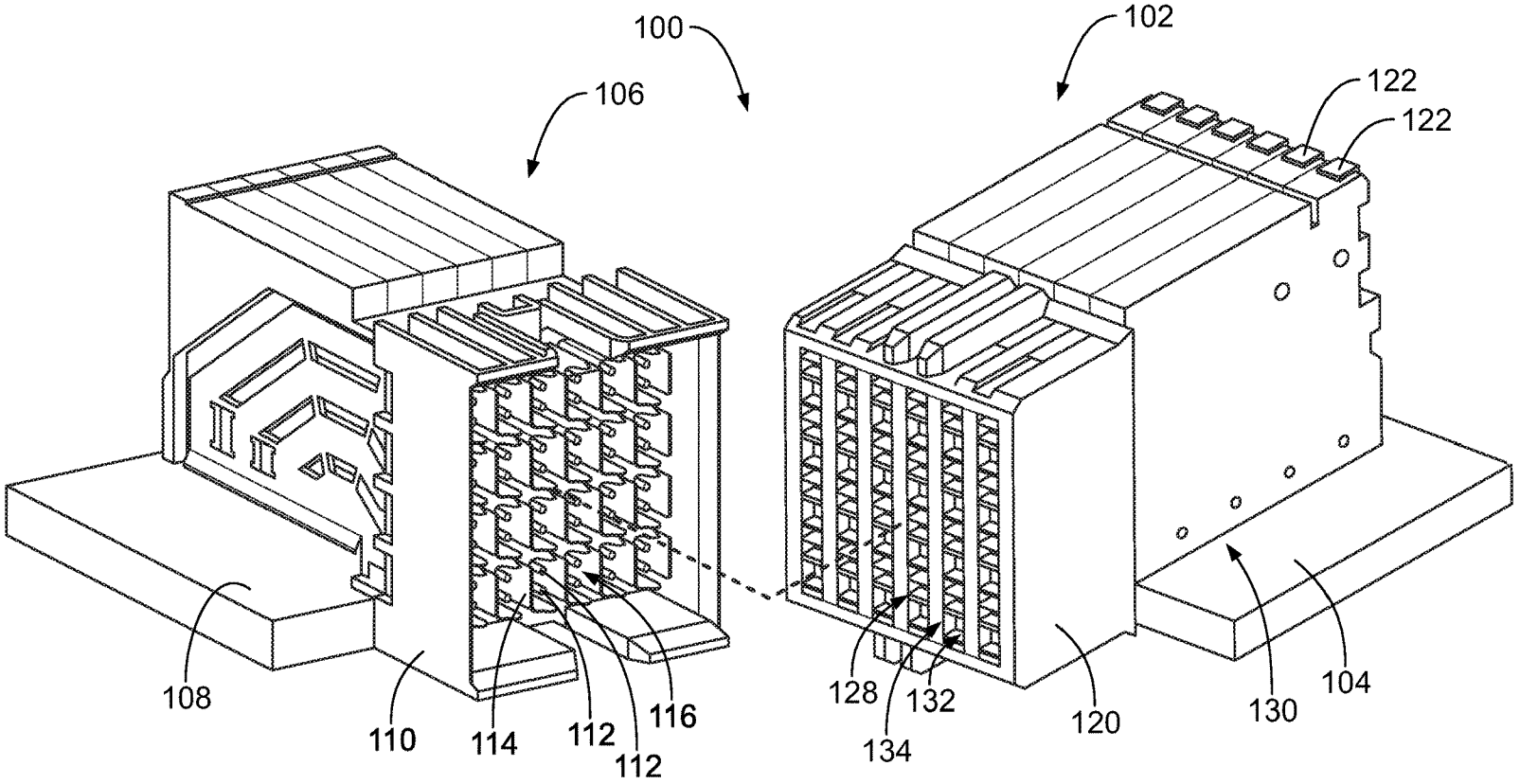
FIG. 1 is a front perspective view of an electrical connector system including an electrical connector having contact modules formed in accordance with an exemplary embodiment.

FIG. 1 is a front perspective view of an electrical connector system 100 formed in accordance with an exemplary embodiment. The connector system 100 includes an electrical connector 102 configured to be mounted to a circuit board 104, and a mating electrical connector 106 which may be mounted to a circuit board 108. The mating electrical connector 106 may be a header connector. Various types of connector assemblies may be used in various embodiments, such as a right angle connector, a vertical connector or another type of connector.

The mating electrical connector 106 includes a housing 110 holding a plurality of mating signal contacts 112 and mating ground shields 114. The mating signal contacts 112 may be arranged in pairs 116. Each mating ground shield 114 extends around corresponding mating signal contacts 112, such as the pairs 116 of mating signal contacts 112. In the illustrated embodiment, the mating ground shields 114 are C-shaped having three walls extending along three sides of each pair of mating signal contacts 112. The mating ground shield 114 below the pair 116 provides electrical shielding across the bottom of the pair 116. As such, the pairs 116 of mating signal contacts 112 are circumferentially surrounded on all four sides by the mating ground shields 114.

The electrical connector 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector 102. The contact modules 122 each include a plurality of signal contacts 124 (shown in FIG. 2) that define signal paths through the electrical connector 102. The signal contacts 124 are configured to be electrically connected to corresponding mating signal contacts 112 of the mating electrical connector 106.

The electrical connector 102 includes a mating end 128, such as at a front of the electrical connector 102, and a mounting end 130, such as at a bottom of the electrical connector 102. In the illustrated embodiment, the mounting end 130 is oriented substantially perpendicular to the mating end 128. The mating and mounting ends 128, 130 may be at different locations other than the front and bottom in alternative embodiments. The signal contacts 124 extend through the electrical connector 102 from the mating end 128 to the mounting end 130 for mounting to the circuit board 104.

The signal contacts 124 are received in the housing 120 and held therein at the mating end 128 for electrical termination to the mating electrical connector 106. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single ended applications. Optionally, the pairs of signal contacts 124 may be arranged in columns (pair-in-column signal contacts). Alternatively, the pairs of signal contacts 124 may be arranged in rows (pair-in-row signal contacts). The signal contacts 124 within each pair may be contained within the same contact module 122.

In an exemplary embodiment, each contact module 122 has a shield structure 126 (shown in FIG. 3) for providing electrical shielding for the signal contacts 124. The shield structure 126 is configured to be electrically connected to the mating ground shields 114 of the mating electrical connector 106. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 provide shielding for each pair of signal contacts 124 along substantially the entire length of the signal contacts 124 between the mating end 128 and the mounting end 130. In an exemplary embodiment, the shield structure 126 is configured to be electrically connected to the mating electrical connector and/or the circuit board 104. The shield structure 126 may be electrically connected to the circuit board 104 by features, such as grounding pins and/or surface tabs.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding mating signal contacts 112 of the mating electrical connector 106. In the illustrated embodiment, the ground contact openings 134 are C-shaped extending along one of the sides as well as the top and the bottom of the corresponding pair of signal contact openings 132. The ground contact openings 134 receive mating ground shields 114 of the mating electrical connector 106 therein. The ground contact openings 134 also receive portions of the shield structure 126 (for example, beams and/or fingers) that mate with the mating ground shields 114 to electrically common the shield structure 126 with the mating electrical connector 106.

The housing 120 is manufactured from a dielectric material, such as a plastic material, and provides isolation between the signal contact openings 132 and the ground contact openings 134. The housing 120 isolates the signal contacts 124 from the shield structure 126. The housing 120 isolates each set (for example, differential pair) of signal contacts 124 from other sets of signal contacts 124.

Figure 2:
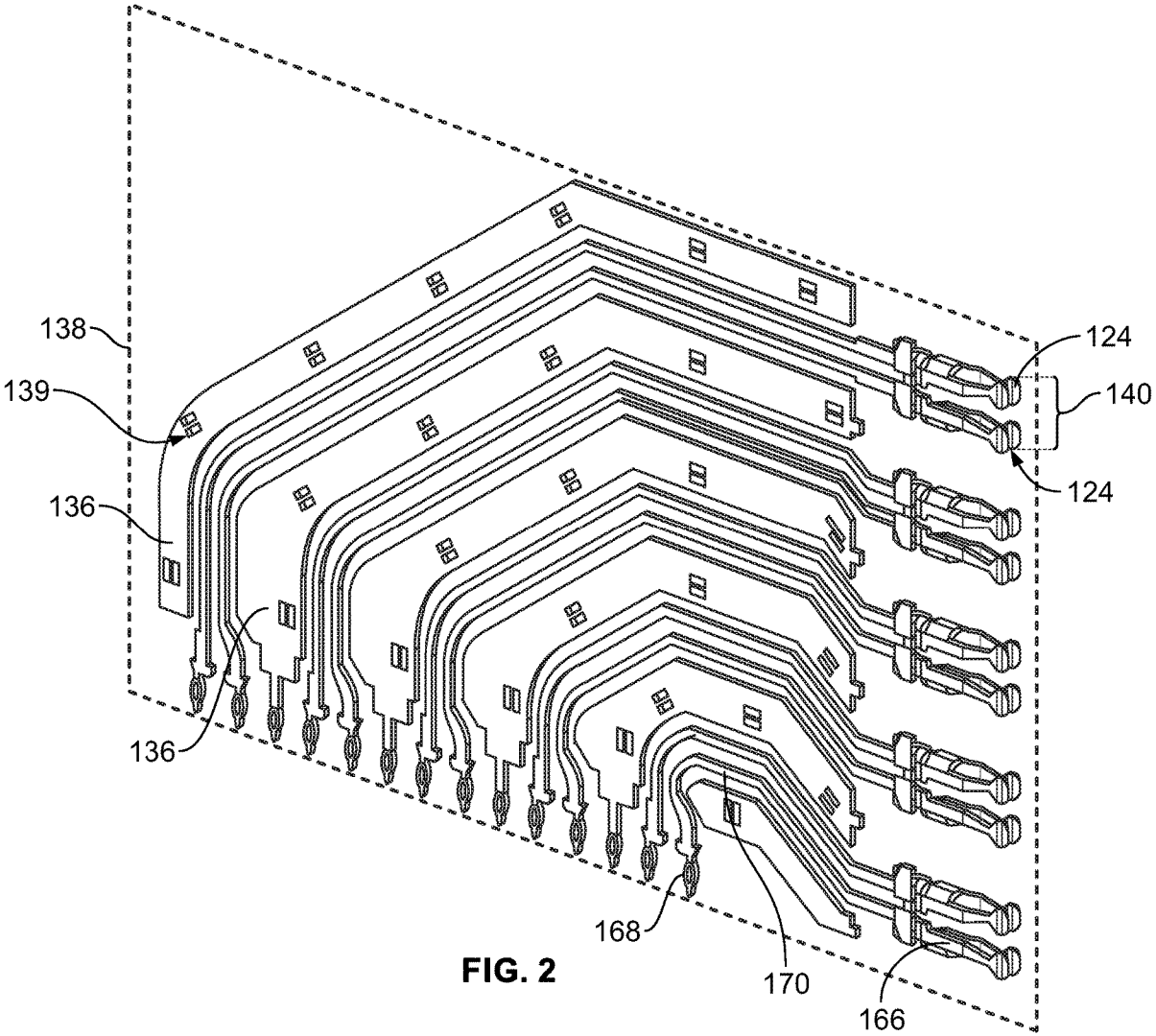
FIG. 2 is a perspective view of a portion of one of the contact modules showing signal contacts thereof in accordance with an exemplary embodiment.

FIG. 2 is a perspective view of a portion of one of the contact modules 122 showing the signal contacts 124. The signal contacts 124 are arranged in an array. FIG. 2 shows ground contacts or guard traces 136 in a contact plane 138 with the array of signal contacts 124. The guard traces 136 are arranged between corresponding signal contacts 124, such as between pairs 140 of the signal contacts 124. The guard traces 136 form part of the shield structure 126. The guard traces 136 provide electrical shielding between the signal contacts 124, such as between the pairs 140 of the signal contacts 124.

In an exemplary embodiment, the signal contacts 124 and the guard traces 136 are stamped and formed from a common sheet of metal, such as a leadframe. The guard traces 136 are coplanar with the signal contacts 124. Edges of the guard traces face edges of the signal contacts 124 with gaps therebetween. The gaps may be filled with dielectric material or air to electrically isolate the guard traces 136 from the signal contacts 124 when the contact module 122 is manufactured, such as by an overmolded dielectric body. In an exemplary embodiment, the guard traces 136 include slots 139 therein, which may be used to electrically common the guard traces 136 with other portions of the shield structure 126.

Figure 3:
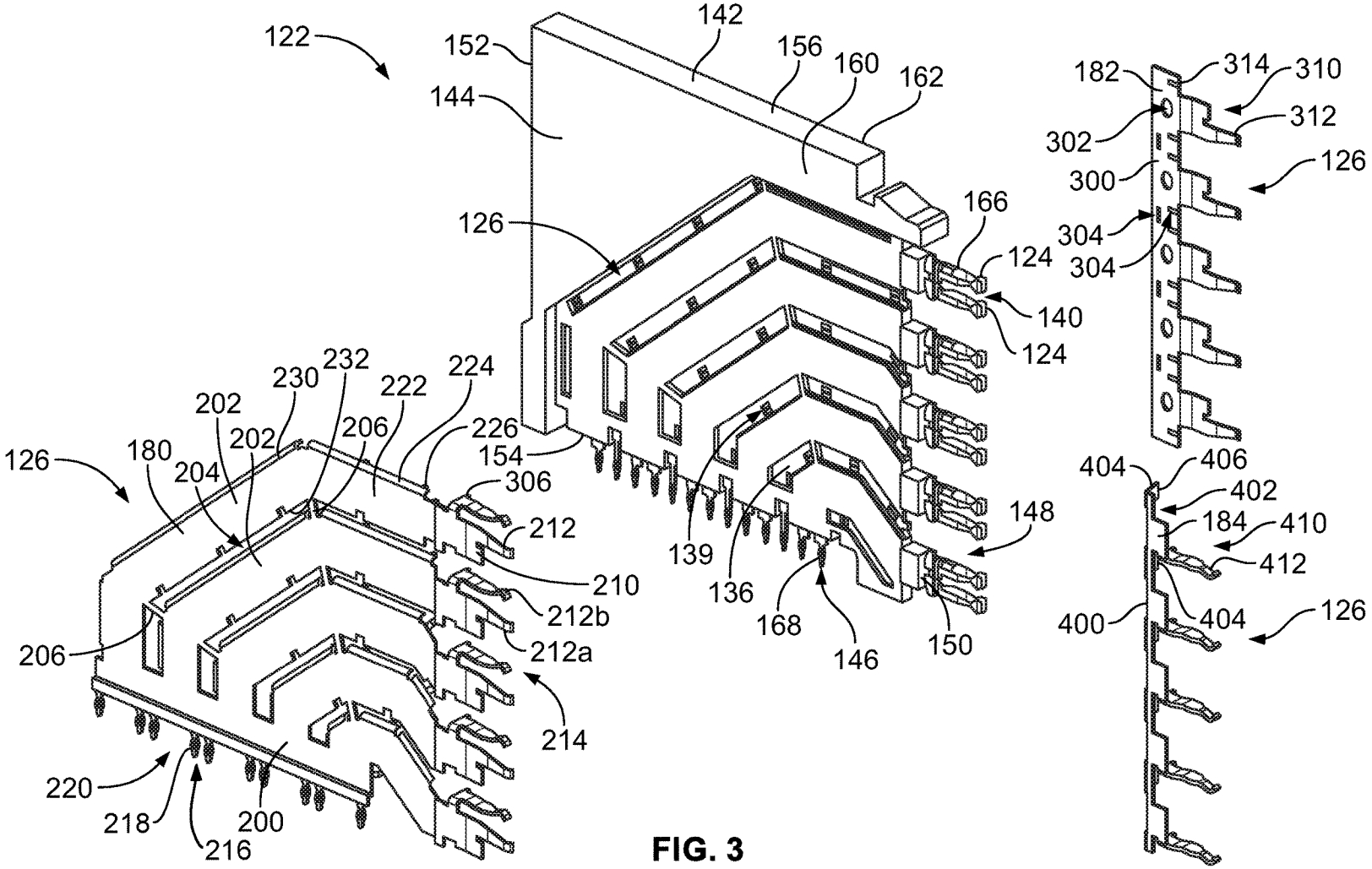
FIG. 3 is an exploded view of one of the contact modules in accordance with an exemplary embodiment.

FIG. 3 is an exploded view of one of the contact modules 122 in accordance with an exemplary embodiment. The contact module 122 includes a frame assembly having the signal contacts 124 and guard traces 136 with a dielectric frame or holder 142 holding the signal contacts 124 and the guard traces 136. The dielectric holder 142 generally surrounds the signal contacts 124 and the guard traces 136 along substantially the entire lengths thereof between a mounting end 146 at the bottom and a mating end 148 at the front. The shield structure 126 is held by and/or configured to be coupled to the dielectric holder 142 to provide electrical shielding for the signal contacts 124. The shield structure 126 provides circumferential shielding for each pair 140 of signal contacts 124 along at least a majority of a length of the signal contacts 124, such as substantially an entire length of the signal contacts 124.

The dielectric holder 142 is formed from a dielectric body 144 at least partially surrounding the signal contacts 124 and the guard traces 136. The dielectric body 144 may be overmolded over the signal contacts 124 and the guard traces 136. Portions of the signal contacts 124 and the guard traces 136 are encased in the dielectric body 144. The dielectric holder 142 has a front 150 configured to be loaded into the housing 120 (shown in FIG. 1), a rear 152 opposite the front 150, a bottom 154 which optionally may be adjacent to the circuit board 104 (shown in FIG. 1), and a top 156 generally opposite the bottom 154. The dielectric holder 142 also includes first and second sides 160, 162, such as a right side 160 and a left side 162.

In an exemplary embodiment, portions of the shield structure 126 (such as the guard traces 136) are at least partially encased in the dielectric body 144, while other portions of the shield structure 126 are coupled to the exterior of the dielectric body 144, such as the right side 160 and/or the left side 162 of the dielectric holder 142. In the illustrated embodiment, the guard traces 136 are arranged along the contact plane 138 (shown in FIG. 2) between, and optionally parallel to, the first and second sides 160, 162. Additionally, in the illustrated embodiment, portions of the shield structure 126 are coupled to both the right and left sides 160, 162, such as at the front 150.

Each signal contact 124 has a mating portion 166 extending forward from the front 150 of the dielectric holder 142, and a mounting portion 168 extending downward from the bottom 154. Each signal contact 124 has a transition portion 170 (shown in FIG. 2) between the mating and mounting portions 166, 168. The transition portions 170 each include a top, a bottom, a right side, and a left side. In an exemplary embodiment, the top of the outermost signal contact 124 within the pair 140 and the bottom of the innermost signal contact 124 with the pair 140 are shielded from signal contacts 124 of the adjacent pair 140 by the guard traces 136. The right side of each signal contact 124 is covered by the shield structure 126 to shield the signal contacts 124 from signal contacts 124 in an adjacent contact module 122. The mating portions 166 are configured to be electrically terminated to corresponding mating signal contacts 112 (shown in FIG. 1) when the electrical connector 102 is mated to the mating electrical connector 106 (shown in FIG. 1). In an exemplary embodiment, the mounting portions 168 include compliant pins, such as eye-of-the-needle pins, configured to be terminated to the circuit board 104 (shown in FIG. 1).

In an exemplary embodiment, the shield structure 126 includes first and second ground shields 180, 182 and a ground clip 184. The ground shields 180, 182 and the ground clip 184 are each separate stamped and formed pieces configured to be mechanically and electrically connected together to form part of the shield structure. The ground shields 180, 182 and/or the ground clip 184 are configured to be electrically connected to the guard traces 136 to electrically common all of the components of the shield structure 126. In various embodiments, the ground clip 184 may be integral with (for example, stamped and formed with) the second ground shield 182 and/or the first ground shield 180. The ground shields 180, 182 and the ground clip 184 cooperate to provide circumferential shielding for each pair 140 of signal contacts 124 at the mating end 148. When assembled, the first ground shield 180 is positioned along the right side 160 of the dielectric holder 142 and the second ground shield 182 is positioned along the left side 162 of the dielectric holder 142, while the ground clip 184 is provided at the front 150 of the dielectric holder 142. The ground shields 180, 182 and the ground clip 184 electrically connect the contact module 122 to the mating electrical connector 106, such as to the mating ground shields 114 thereof (shown in FIG. 1), thereby electrically commoning the connection between the electrical connector 102 and the mating electrical connector. The ground shield 180 electrically connects the contact module 122 to the circuit board 104, such as through compliant pins thereof.

Figure 4:
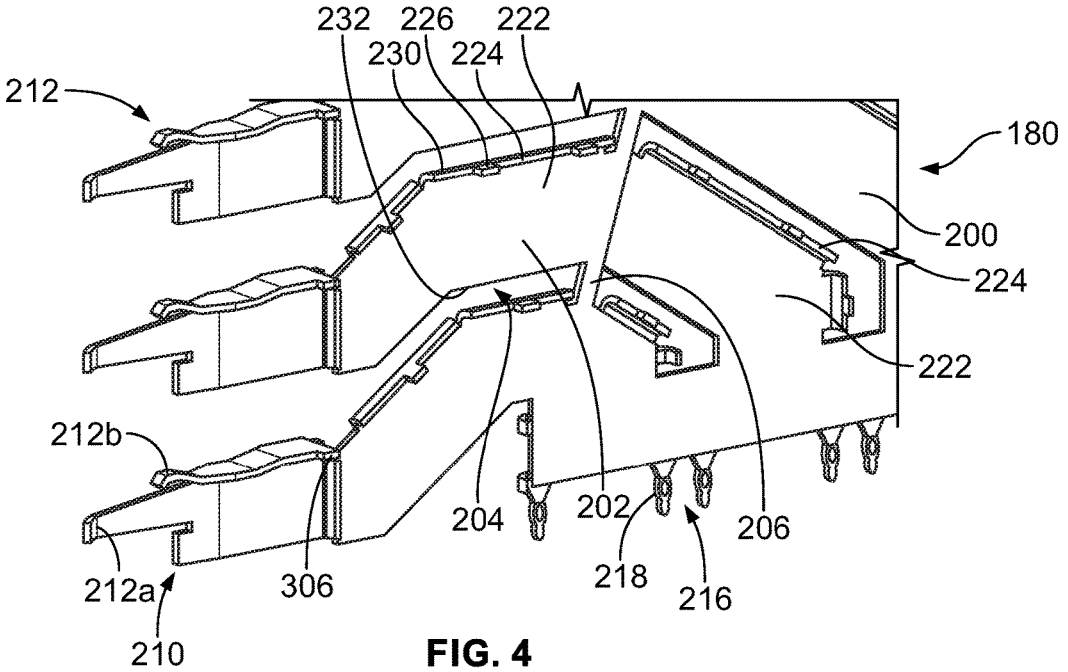
FIG. 4 is a side perspective view of a portion of a ground shield of the contact module in accordance with an exemplary embodiment.

With additional reference to FIG. 4, which is a side perspective view of a portion of the first ground shield 180, the ground shield 180 is stamped and formed from a stock piece of metal material. In an exemplary embodiment, the ground shield 180 includes a main body 200 configured to extend along the right side 160 of the dielectric holder 142 (although the ground shield 180 may be reversed and designed to extend along the left side 162 in other various embodiments). The main body 200 may include a plurality of rails 202 separated by gaps 204, which may be interconnected by connecting strips 206 between the rails 202. The rails 202 are configured to extend along and follow the paths of the signal contacts 124, such as between the mating end 148 and the mounting end 146. For example, the rails 202 may transition from a mating end 214 to a mounting end 220 of the ground shield 180.

The ground shield 180 includes mating portions 210 defined by mating beams 212 at the mating end 214 of the main body 200. The mating portions 210 are configured to be mated with corresponding mating portions of the mating electrical connector 106 (for example, the C-shaped mating ground shields 114, shown in FIG. 1). In an exemplary embodiment, the ground shield 180 includes side mating beams **212*a* and top mating beams 212*b*** configured to extend along the sides and the tops of the mating portions 166 of corresponding signal contacts 124. The mating beams 212 may be deflectable mating beams, such as spring beams. Optionally, the mating beams 212 are configured to be received inside the corresponding C-shaped mating ground shields 114 of the mating electrical connector 106. Alternatively, the mating beams 212 are configured to extend along the outside of the corresponding C-shaped mating ground shields 114 of the mating electrical connector.

The ground shield 180 includes mounting portions 216 defined by compliant pins 218 at the mounting end 220 of the main body 200. The mounting portions 216 are configured to be terminated to the circuit board 104 (shown in FIG. 1). For example, the mounting portions 216 are configured to be received in plated vias in the circuit board 104.

The rails 202 are configured to provide shielding along the sides of the signal contacts 124 of the corresponding pair 140. For example, in an exemplary embodiment, the rails 202 have side strips 222 configured to extend along the right side 160 of the dielectric holder 142 and connecting strips 224 configured to extend into the dielectric holder 142 and extend between corresponding signal contacts 124. The connecting strips 224 extend into the dielectric holder 142 to directly engage the guard traces 136. The connecting strips 224 are bent perpendicular to and extend from the corresponding side strips 222. For example, the side strips 222 have first and second edges 230, 232 and the connecting strips 224 extend from the first edges 230; however the connecting strips 224 may extend from the second edges 232 in other various embodiments. When the connecting strips 224 are bent out of the plane of the side strips 222, the gaps 204 are formed between the rails 202. In an exemplary embodiment, the connecting strips 224 extend the majority of the length of the rails 202, such as substantially the entire lengths of the rails 202 to define many points of contact with the guard traces 136 along the lengths of the guard traces 136.

The side strips 222 and the connecting strips 224 form right angle or L-shaped rails. The side strips 222 generally follow the paths of the transition portions 170 of the signal contacts 124. The side strips 222 provide shielding along the sides of the pair 140 of signal contacts 124. The side strips 222 have a width at least as wide as the pair of signal contacts 124. Optionally, the side strips 222 may be wide enough to overlap both flanking guard traces 136. In an exemplary embodiment, the connecting strips 224 are only provided along the first edge 230, as opposed to both edges 230, 232 to limit the width of the gap 204. For example, if both edges were folded inward, the width of the gap would be larger. Additionally, the spacing between the signal contacts 124 would need to be widened to provide more material in the rail 202 to allow bending both edges inward to create connecting strips 224 on both edges 230, 232, which would increase the overall size of the contact module 122.

In an exemplary embodiment, each connecting strip 224 includes one or more commoning features 226 for electrically connecting the ground shield 180 to the guard trace 136. In the illustrated embodiment, the commoning features 226 are commoning tabs, and may be referred to hereinafter as commoning tabs 226, which extend outward from the connecting strips 224; however, other types of commoning features may be used in alternative embodiments, such as channels, slots, spring beams, and the like. The commoning features 226 may be deflectable to engage and securely couple the ground shield 180 to the guard traces 136 when mated thereto. For example, the commoning features 226 may be received in the corresponding slots 139 in the guard traces 136. The commoning features 226 may pass though the slots 139 and may clip to the guard traces 136 to mechanically secure the ground shield 180 to the guard traces 136. Optionally, each connecting strip 224 includes at least one commoning tab 226. As such, each rail 202 has multiple points of contact with the corresponding guard trace 136.

The second ground shield 182 is stamped and formed from a stock piece of metal material. The ground shield 182 includes a main body 300 configured to extend along the left side 162 of the dielectric holder 142. The main body 300 may be generally planar and configured to attach to the front 150 of the dielectric holder 142; however, the main body 300 may extend between the mating end 148 and the mounting end 146 in other various embodiments, similar to the first ground shield 180. The ground shield 182 includes openings 302 for mounting to the dielectric holder 142 from the left side 162; however, the ground shield 182 may include other types of mounting features in alternative embodiments. The ground shield 182 includes slots 304 used for coupling the ground shield 182 to the first ground shield 180 and the ground clip 184; however other types of connecting features may be used in alternative embodiments to electrically connect the ground shield 182 with the ground shield 180 and/or the ground clip 184. The slots 304 receive connecting tabs 306 of the first ground shield 180 and connecting tabs 406 of the ground clip 184. The slots 304 may be sized and shaped to electrically connect to the tabs 306, 406. For example, the slots 304 may have crush tabs or bumps to engage the tabs 306, 406 by an interference fit.

The ground shield 182 includes mating portions 310 defined by mating beams 312 at a mating end 314 of the main body 300. The mating portions 310 are configured to be mated with corresponding mating portions of the mating electrical connector (for example, the C-shaped mating ground shields 114, shown in FIG. 1). In an exemplary embodiment, the mating beams 312 are side mating beams configured to extend along the sides of the corresponding signal contacts 124; however the mating beams 312 may extend along other portions of the signal contacts 124. The mating beams 312 may be deflectable mating beams, such as spring beams. Optionally, the mating beams 312 are configured to be received inside the corresponding C-shaped mating ground shields 114 of the mating electrical connector 106. Alternatively, the mating beams 312 are configured to extend along the outside of the corresponding C-shaped mating ground shields 114 of the mating electrical connector.

The ground clip 184 is stamped and formed from a stock piece of metal material. The ground clip 184 includes a main body 400 configured to extend along the front 150 of the dielectric holder 142. The main body 400 may be generally planar and configured to attach to the front 150 of the dielectric holder 142. The ground clip 184 includes openings 402 between pads 404 that receive the mating portions 166 of the signal contacts 124. The pads 404 are positioned between adjacent pairs 140 of the signal contacts 124. The pads 404 are configured to directly engage the second ground shield 182. In an exemplary embodiment, the connecting tabs 406 extend from the pads 404 to engage the second ground shield 182.

The ground clip 184 includes mating portions 410 defined by mating beams 412. The mating portions 410 are configured to be mated with corresponding mating portions of the mating electrical connector (for example, the C-shaped mating ground shields 114, shown in FIG. 1). In an exemplary embodiment, the mating beams 412 are bottom mating beams configured to extend along the bottom of the corresponding signal contacts 124; however the mating beams 412 may extend along other portions of the signal contacts 124. The mating beams 412 may be deflectable mating beams, such as spring beams. Optionally, the mating beams 412 are configured to be received inside the corresponding C-shaped mating ground shields 114 of the mating electrical connector 106. Alternatively, the mating beams 412 are configured to extend along the outside of the corresponding C-shaped mating ground shields 114 of the mating electrical connector.

Figure 5:
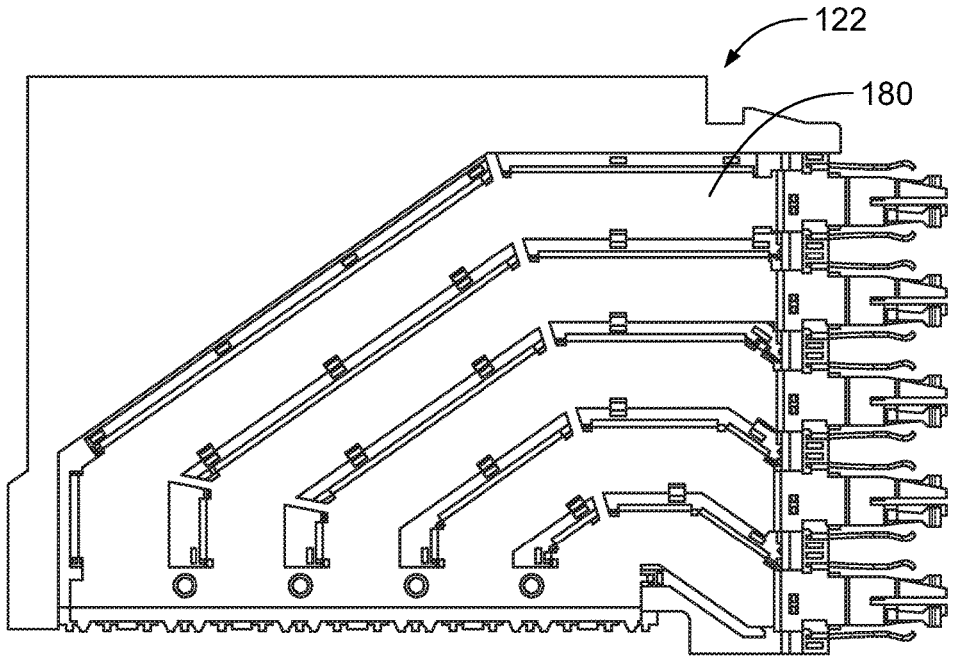
FIG. 5 is a side view of the contact module showing the ground shield.
Figure 6:
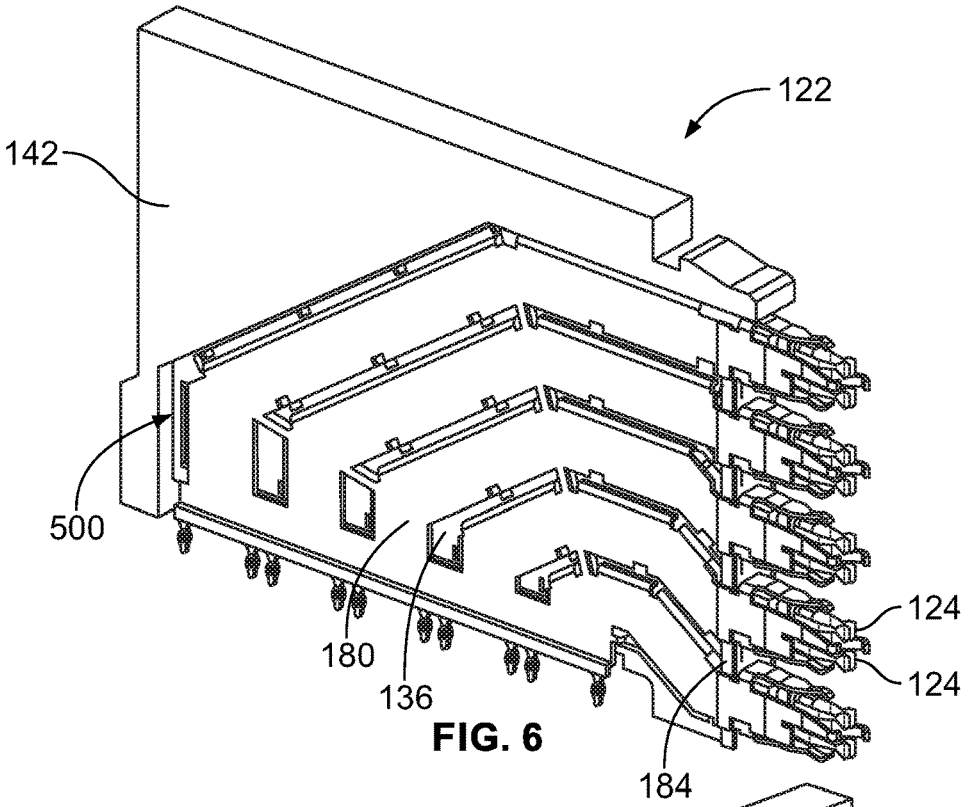
FIG. 6 is a side perspective view of the contact module in an assembled state showing the ground shield.
Figure 7:
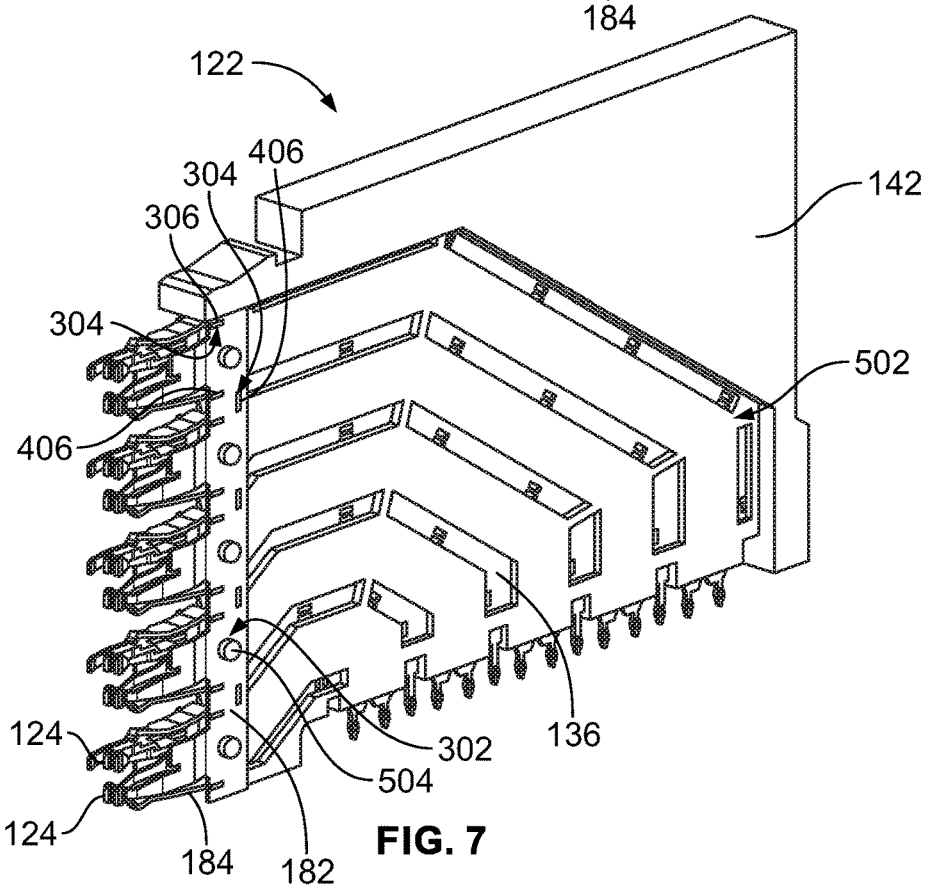
FIG. 7 is a side perspective view of the contact module in an assembled state showing a ground shield in accordance with an exemplary embodiment.

FIG. 5 is a side view of the right side of the contact module 122 showing the first ground shield 180. FIG. 6 is a side perspective view of the right side of the contact module 122 in an assembled state showing the first ground shield 180. FIG. 7 is a side perspective view of the left side of the contact module 122 in an assembled state showing the second ground shield 182. The ground shields 180, 182 are received in pockets 500, 502 (shown in FIGS. 6 and 7, respectively) and may be mechanically connected to the dielectric holder 142. For example, posts 504 (shown in FIG. 7) are received in corresponding openings 302.

The first ground shield 180 is electrically connected to the guard traces 136 and provides shielding for the signal contacts 124. The second ground shield 182 is electrically connected to the first ground shield 180 and the ground clip 184. For example, as shown in FIG. 7, the connecting tabs 306, 406 are received in the slots 304.

Figure 8:
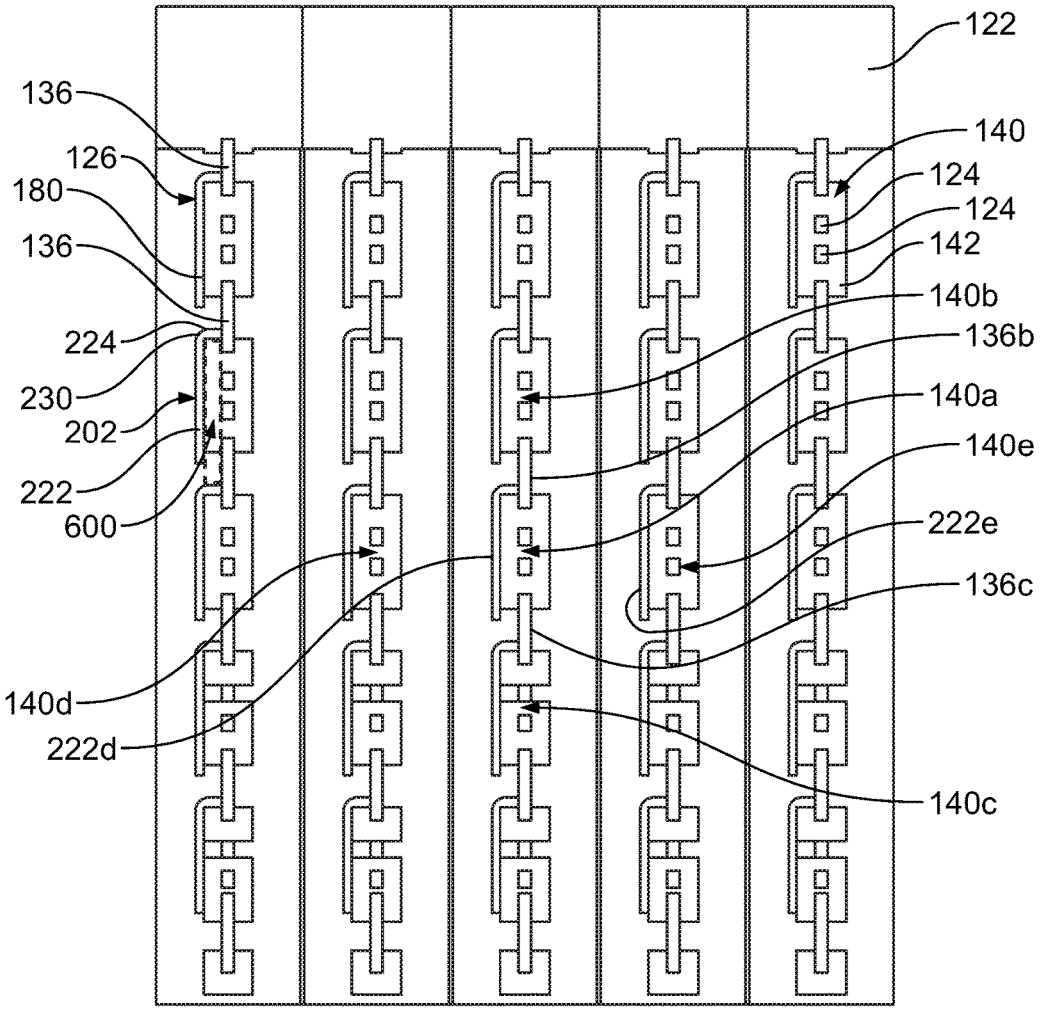
FIG. 8 illustrates shield structures of contact modules providing electrical shielding for pairs of signal contacts in accordance with an exemplary embodiment.

FIG. 8 illustrates the shield structures 126 of the contact modules 122 providing electrical shielding for the pairs 140 of signal contacts 124. The ground shields 180 of each contact module 122 are shown electrically connected to the guard traces 136 between the pairs 140 of signal contacts 124. The ground shields 180 provide electrical shielding between adjacent contact modules 122. The guard traces 136 provide electrical shielding within the contact modules 122, such as between adjacent pairs 140 of the signal contacts 124 of the same contact module 122.

The shield structures 126 cooperate to provide circumferential shielding for each pair of signal contacts 124. Each pair 140 of signal contacts 124 is electrically shielded from each other pair 140 of signal contacts 124. The shield structure 126 is positioned along each line of sight between the pairs 140. For example, with reference to the pair 140*a*, the pair 140*a* is electrically shielded from the pair 140*b* above by the guard trace 136*b* above, and the pair 140*a* is electrically shielded from the pair 140*c* below by the guard trace 136*c* below. The pair 140*a* is electrically shielded from the pair 140*d* to the right side by the side strip 222*d* on the right side of the same contact module 122. The pair 140*a* is electrically shielded from the pair 140*e* to the left side by the side strip 222*e* on the contact module 122 to the left.

In an exemplary embodiment, dielectric material separates the shield structure 126 from the signal contacts 124. For example, the dielectric material of the dielectric holder 142 substantially fills a space 600 bounded by the side strip 222 of the rail 202 and the corresponding signal contacts 124 and bounded by the connecting strip 224 extending from the first edge 230 of such rail 202 and the connecting strip 224 extending from the first edge 230 of the adjacent rail 202. Air may fill the portion of the space 600 not filled by the dielectric material. For example, in various embodiments, only air and/or dielectric material fills the space 600 between the connecting strips 224 at the first edges 230 of each of the rails 202.

Figure 9:
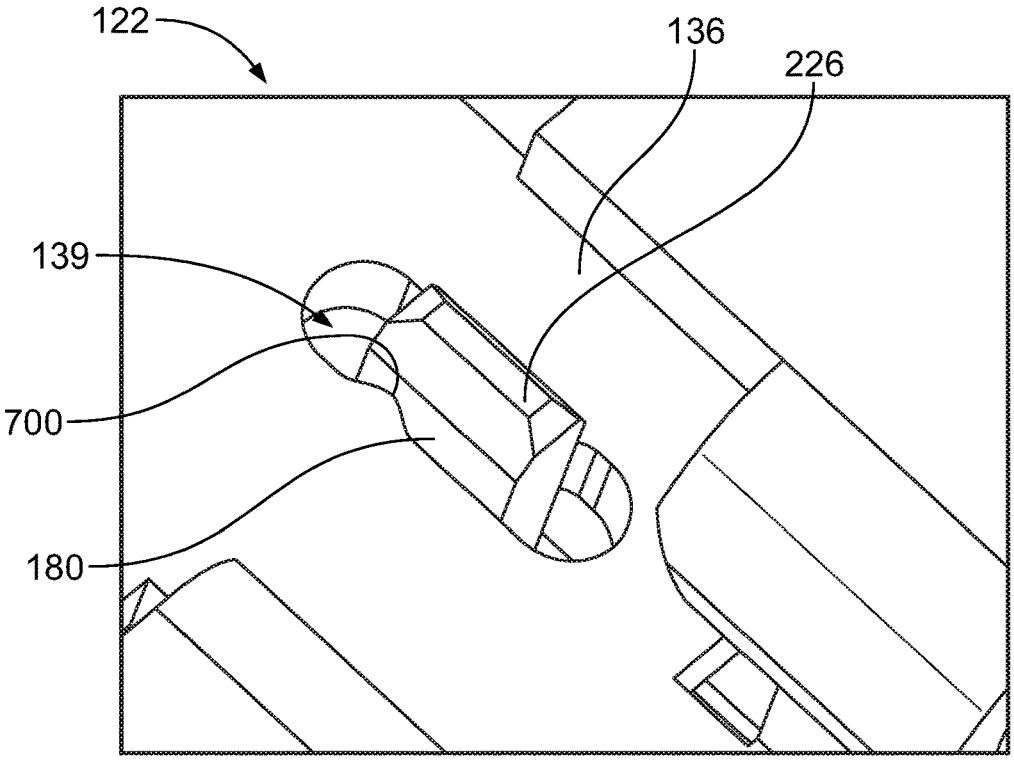
FIG. 9 is a perspective view of a portion of the contact module showing the ground shield coupled to a guard trace of the contact module in accordance with an exemplary embodiment.
Figure 10:
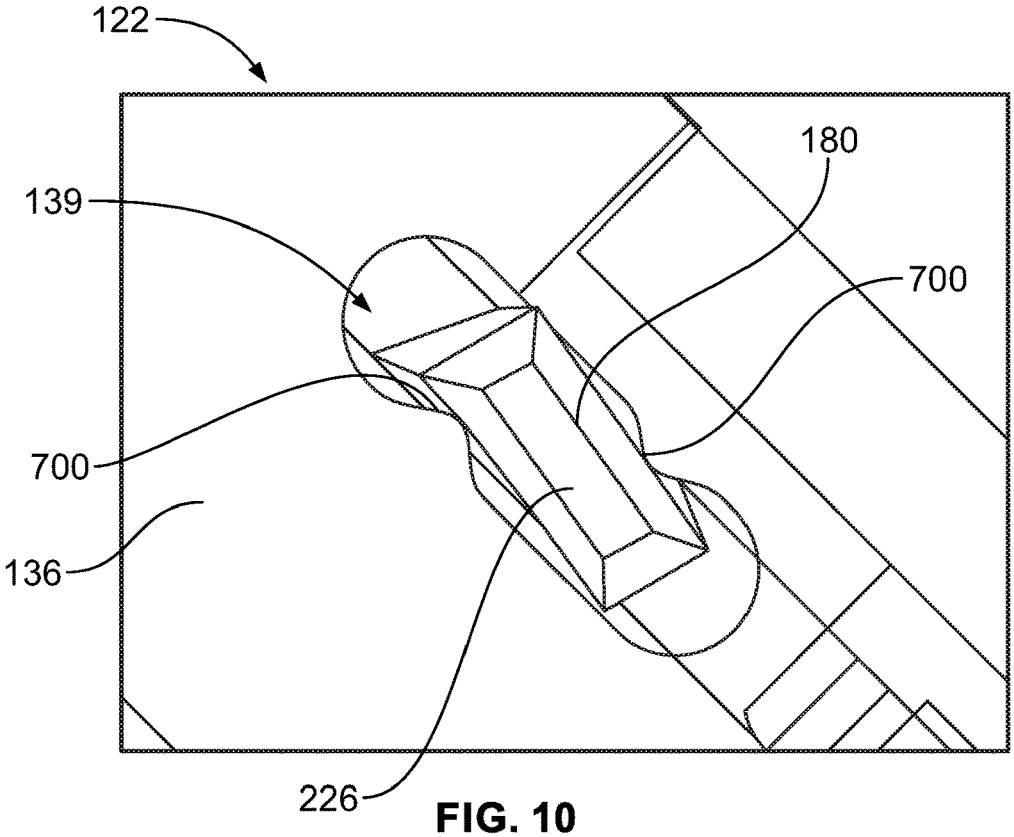
FIG. 10 is a side view of a portion of the contact module showing the ground shield coupled to the guard trace.

FIG. 9 is a perspective view of a portion of the contact module 122 showing the ground shield 180 coupled to the guard trace 136. FIG. 10 is a side view of a portion of the contact module 122 showing the ground shield 180 coupled to the guard trace 136. The slot 139 receives the commoning tab 226. In an exemplary embodiment, the guard trace 136 includes one or more projections 700 extending into the slot 139. For example, two projections 700 may be provided on opposite sides of the slot 139. The projections 700 may be offset from each other. The projections 700 may interfere with the commoning tab 226 when the commoning tab 226 is loaded into the slot 139, which may enhance the mechanical connection between the ground shield 180 and the guard trace 136. Optionally, the commoning tab 226 may be torqued or twisted when engaging the projections 700 to further capture and enhance the mechanical and electrical connection between the ground shield 180 and the guard trace 136.

Figure 11:
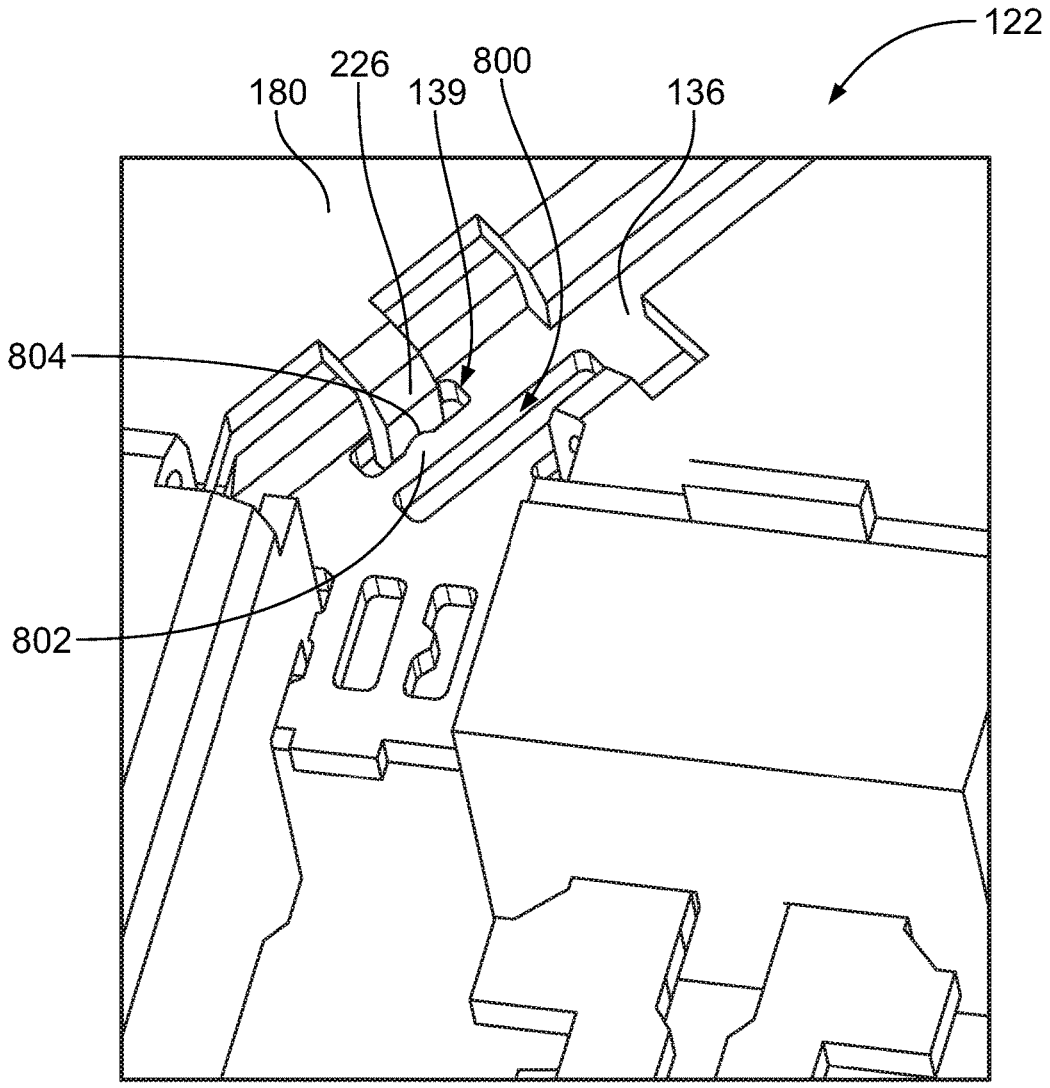
FIG. 11 is a perspective view of a portion of the contact module showing the ground shield coupled to the guard trace.

FIG. 11 is a perspective view of a portion of the contact module 122 showing the ground shield 180 coupled to the guard trace 136. The slot 139 receives the commoning tab 226. In an exemplary embodiment, the guard trace 136 includes a relief slot 800 adjacent the slot 139. A beam 802 is provided between the slot 139 and the relief slot 800. A projection 804 extends into the slot 139 from the beam 802. The beam 802 is configured to be flexed into the relief slot 800 when the commoning tab 226 is loaded into the slot 139. The projection 804 may interfere with the commoning tab 226 when the commoning tab 226 is loaded into the slot 139, which may enhance the mechanical connection between the ground shield 180 and the guard trace 136. The relief slot 80 provides an area of relief for the beam 802 to flex when the commoning tab 226 is loaded into the slot 139.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. A contact module comprising:

a dielectric holder having first and second sides extending between a mating end and a mounting end;

signal contacts held by the dielectric holder along a contact plane defined between the first and second sides, the signal contacts having mating portions extending from the mating end, mounting portions extending from the mounting end for termination to a circuit board, and transition portions extending through the dielectric holder between the mating and mounting portions;

guard traces held by the dielectric holder along the contact plane between corresponding signal contacts, the guard traces being electrically commoned and providing electrical shielding between the corresponding signal contacts, the guard traces including slots having projections extending into the slots, the projections being offset on opposite sides of the corresponding slots; and a ground shield coupled to the first side of the dielectric holder and providing electrical shielding for the signal contacts, the ground shield being electrically connected to each of the guard traces, the ground shield having a plurality of rails for electrically shielding corresponding signal contacts, each of the rails having side strips configured to be aligned with the transition portions of corresponding signal contacts along the first side, the side strips having first and second edges, each of the rails having connecting strips extending inward from the first edges of the side strips into the dielectric holder, the connecting strips having commoning tabs extending therefrom received in corresponding slots and engaging corresponding projections to directly engage the corresponding guard traces, the rails being generally L-shaped defined by the side strips and corresponding connecting strips.

2. The contact module of claim 1, wherein the connecting strips include commoning features that engage the corresponding guard traces to electrically common the guard traces.

3. The contact module of claim 1, wherein the ground shield is stamped and formed having the connecting strips bent perpendicular to and extending from the corresponding side strips.

4. The contact module of claim 1, wherein the dielectric holder substantially fills a space bounded by the side strip and the corresponding signal contact and bounded by the connecting strip extending from the first edge thereof and the connecting strip extending from the first edge of the adjacent rail.

5. The contact module of claim 1, wherein each rail includes multiple points of contact between the connecting strip and the corresponding guard trace.

6. The contact module of claim 1, wherein the connecting tabs are twisted between the offset projections when received in corresponding slots in the guard traces to mechanically and electrically connect the ground shield to the guard traces.

7. The contact module of claim 1, wherein the signal contacts are arranged in pairs carrying differential signals, the guard traces being positioned between corresponding pairs of the signal contacts, the side strips covering both signal contacts of the corresponding pair of signal contacts.

8. The contact module of claim 1, wherein the ground shield includes a plurality of mating portions at a mating end of the ground shield, the mating portions having mating beams extending along the mating portions of the signal contacts.

9. A shield structure for a contact module having a dielectric holder holding signal contacts and guard traces between corresponding signal contacts, the shield structure comprising:

a ground shield configured to extend along a first side of the dielectric holder, the ground shield having a main body having a plurality of rails separated by gaps;

the rails having side strips configured to extend along the first side of the dielectric holder, the side strips having first and second edges;

the rails having connecting strips extending inward from the first edges of the side strips and configured to extend into the dielectric holder to directly engage the corresponding guard traces, each connecting strip having at least one commoning feature extending therefrom configured to be received in a corresponding slot in the corresponding guard trace to mechanically and electrically connect the ground shield to the guard trace;

the rails being generally L-shaped defined by the side strips and corresponding connecting strips wherein the second edges are in plane with the side strips and configured to face adjacent rails.

10. The shield structure of claim 9, wherein the ground shield is stamped and formed having the connecting strips bent perpendicular to and extending from the corresponding side strips.

11. The shield structure of claim 9, wherein the connecting strip of a first of the rails is positioned between the connecting strips of second and third rails flanking the first rail.

12. The shield structure of claim 9, wherein each rail includes a plurality of connecting tabs defining points of contact between the connecting strip and the corresponding guard trace.

13. The shield structure of claim 9, wherein each commoning feature is a connecting tab extending from an edge of the connecting strip.

14. The shield structure of claim 9, wherein the side strips have a width sufficient to cover a pair of signal contacts.

15. The shield structure of claim 9, wherein the ground shield includes a plurality of mating portions at a mating end of the ground shield, the mating portions having mating beams configured to extend along mating portions of the signal contacts.

16. An electrical connector comprising:

a housing having a mating end, contact modules arranged in a contact module stack received in and extending from the housing for termination to a circuit board;

wherein each contact module comprises:

a dielectric holder having first and second sides extending between a mating end and a mounting end;

signal contacts held by the dielectric holder along a contact plane defined between the first and second sides, the signal contacts having mating portions extending from the mating end, mounting portions extending from the mounting end for termination to a circuit board, and transition portions extending through the dielectric holder between the mating and mounting portions;

guard traces held by the dielectric holder along the contact plane between corresponding signal contacts, the guard traces being electrically commoned and providing electrical shielding between the corresponding signal contacts, the guard traces having slots; and a ground shield coupled to the first side of the dielectric holder and providing electrical shielding for the signal contacts, the ground shield being electrically connected to each of the guard traces, the ground shield having a plurality of rails for electrically shielding corresponding signal contacts, each of the rails having side strips configured to be aligned with the transition portions of corresponding signal contacts along the first side, the side strips having first and second edges, each of the rails having connecting strips extending inward from the first edges of the side strips into the dielectric holder to directly engage the corresponding guard traces, each connecting strip having at least one commoning feature extending therefrom received in the corresponding slot in the corresponding guard trace to mechanically and electrically connect the ground shield to the guard trace, the rails being generally L-shaped defined by the side strips and corresponding connecting strips wherein the second edges are in plane with the side strips and configured to face adjacent rails.

17. The electrical connector of claim 16, wherein the connecting strips include commoning features that engage the corresponding guard traces to electrically common the guard traces.

18. The electrical connector of claim 16, wherein the ground shield is stamped and formed having the connecting strips bent perpendicular to and extending from the corresponding side strips.

19. The electrical connector of claim 16, wherein each guard trace includes slots having projections extending into the slots, the projections being offset on opposite sides of the corresponding slots, the connecting strips including connecting tabs received in corresponding slots in the guard traces the connecting strips having commoning tabs extending therefrom received in corresponding slots and engaging corresponding projections to mechanically and electrically connect the ground shield to the guard traces.

20. The shield structure of claim 9, wherein the commoning features are received in the slots between projections such that the commoning features are twisted relative to the connecting strip to mechanically hold the commoning features in the slot.

* * * * *